US007108540B2

(12) United States Patent
Annecke

(10) Patent No.: US 7,108,540 B2
(45) Date of Patent: Sep. 19, 2006

(54) ELECTRICAL PIN-AND-SOCKET CONNECTOR

(75) Inventor: Alfred Annecke, Heilbronn (DE)

(73) Assignee: Amphenol-Tuchel-Electronics GmbH, Heilbronn (DE)

( * ) Notice: Subject to any disclaimer, the term of this patent is extended or adjusted under 35 U.S.C. 154(b) by 0 days.

(21) Appl. No.: 11/181,945

(22) Filed: Jul. 15, 2005

(65) Prior Publication Data

US 2006/0014413 A1 Jan. 19, 2006

(30) Foreign Application Priority Data

Jul. 15, 2004 (DE) ..... 10 2004 034 321

(51) Int. Cl.
*H01R 13/627* (2006.01)

(52) U.S. Cl. ..... 439/352

(58) Field of Classification Search ..... 439/352, 439/353, 358

See application file for complete search history.

(56) References Cited

U.S. PATENT DOCUMENTS

| | | | | |
|---|---|---|---|---|
| 4,545,633 | A * | 10/1985 | McGeary | 439/141 |
| 5,275,575 | A * | 1/1994 | Cahaly et al. | 439/188 |
| 5,953,677 | A | 9/1999 | Sato | |
| 6,163,690 | A | 12/2000 | Lilja | |
| 6,530,799 | B1 * | 3/2003 | Regnier et al. | 439/352 |
| 6,544,060 | B1 * | 4/2003 | Wakui et al. | 439/188 |
| 6,910,391 | B1 | 6/2005 | May | |
| 2002/0081888 | A1 * | 6/2002 | Regnier et al. | 439/352 |
| 2002/0160645 | A1 * | 10/2002 | Nagamine et al. | 439/352 |
| 2004/0203699 | A1 | 10/2004 | Oesterling et al. | |

FOREIGN PATENT DOCUMENTS

| | | |
|---|---|---|
| DE | 195 00 959 | 11/1996 |
| DE | 195 34 205 | 9/1997 |
| DE | 198 40 726 | 9/2000 |
| DE | 100 32 234 | 1/2002 |
| DE | 100 32 234 A1 | 1/2002 |
| DE | 101 51 956 | 7/2002 |
| DE | 102 27 016 | 6/2004 |
| EP | 0 591 947 | 4/1994 |
| EP | 1 006 621 | 6/2000 |
| EP | 1 130 692 | 9/2001 |
| EP | 1 150 389 | 10/2001 |

* cited by examiner

*Primary Examiner*—Tulsidas C. Patel
*Assistant Examiner*—Vladimir Imas
(74) *Attorney, Agent, or Firm*—Blank Rome LLP

(57) ABSTRACT

The invention concerns an electrical connector for use between a socket and an electrical control device for a restraint system in motor vehicles. The connector includes a case having contact elements for electrical connection with contact elements of the socket. The case also includes a locking element with at least on extension that engages a spring stop device on the case when the locking element is inserted in the case. The spring stop device is pivotable into a release position through a sliding action.

11 Claims, 3 Drawing Sheets

ELECTRICAL PIN-AND-SOCKET CONNECTOR

DESCRIPTION

Figure 1A:
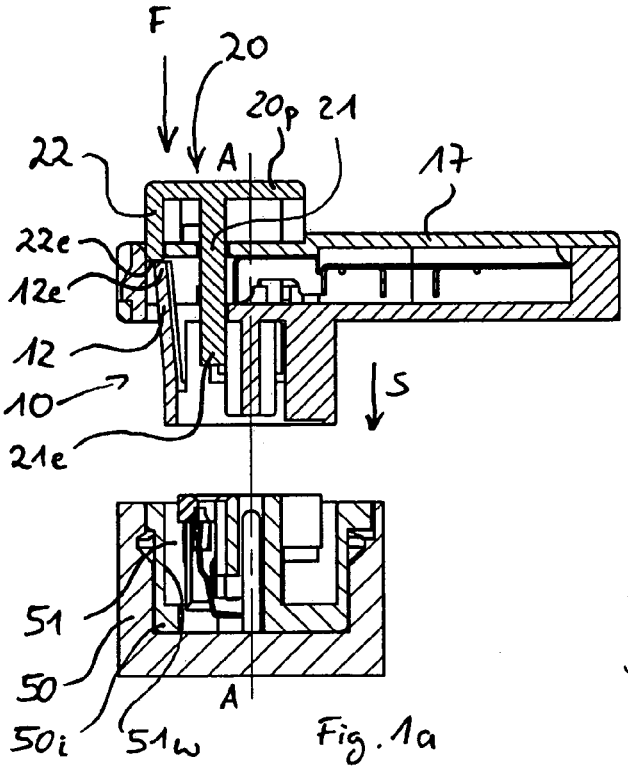

The invention concerns an electrical pin-and-socket connector, particularly for use between a socket (primer capsule) and an electrical control device for a restraint system in motor vehicles, for example, an air bag.

Pin-and-socket connectors of this type are known, for instance, from the following publications: EP 0 591 947 A2, DE 195 34 205 C2, DE 195 00 959 C2, DE 102 27 016 B4.

Such a pin-and-socket connector should have the smallest possible dimensions due to the small amount of space provided in the restraint system. From this it follows that individual components of the pin-and-socket connector, for instance, the accompanying socket, must have an extremely small structural size despite requiring easy assembly, on the one hand, and high operational security, on the other, when used in safety relevant applications (for example, belt tighteners, air bags).

This is especially so with regard to the locking of the connector and socket, whereby the contact elements of the components in the locking state must make secure contact. In addition, the connector and socket may not inadvertently be detached from one another.

In the previously mentioned prior art this problem is solved by the fact that in a first step the connector and the socket contact each other and lock and in a second step a locking element, a so-called secondary latching device, is guided behind a lock arm on the connector to secure the lock against unintentional loosening.

With pin-and-socket connectors in accordance with DE 198 40 726 C2 the locking element can be pre-assembled and lies in the pre-assembled starting position against the action of a spring in a compressed position. Pin-and-socket connector and socket can lock against the action of the spring.

DE 100 32 234 A1, DE 101 51 956 A1, and EP 1130692 A2 also show pin-and-socket connectors with a secondary latching device, whereby the secondary latching device can be held in a preliminary position (e.g., delivery position). From EP 1006621 A2 a pin-and-socket connector is known in which the locking arms are positioned on a locking element, whereby the locking arms are guided functionally independently from the stop arms into a locking position. As a result, the locking arms and stop arms interlock.

With the present invention an alternative design for a pin-and-socket connector is offered that fulfills the following requirements.

A locking element for the secondary latching device of the case and socket should not only be capable of being pre-assembled, but the locking element should at the same time facilitate, in the pre-assembled position, the insertion of the pin-and-socket connector (for example, its respective case section). The locking element is brought into its final position relative to the case of the pin-and-socket connector, wherein it takes on the desired function of a secondary lock in conjunction with the spring stop arms on the case. In so doing, the least possible number of components should be used. Furthermore, the pin-and-socket connector should be stable and should lock securely despite its small structural size. The secondary latching device should prevent a connector that is inserted into a socket from being disconnected in an unintended way through a pull on its cable or other circumstances.

The basic idea of the present invention is to provide a sliding stop device that is positioned in the pin-and-socket connector in such a way that when the electrical pin-and-socket connector is inserted, the stop device pivots from a blocking position to a release position.

In this way the stop device fulfills its function of locking with the secondary latching device when the connector of the electrical pin-and-socket connector is inserted completely into the socket. Through the sliding action the stop device pivots slowly into the release position, in which the secondary lock can be activated. In so doing, the secondary latching device can perform another function, namely, the interruption of a short-circuiting bridge causing the electrical connection of the pin-and-socket connector to be activated.

In the release position a feeder leg or extension of the secondary latching device slides along the spring stop device until the secondary locking element is in its final position, wherein it raises the short-circuiting bridge.

The course of movements follows accordingly in two stages.

First, the locking element and case in the pre-assembled position are inserted together; then the locking element is released from the blocking position with respect to the case and can be moved relative to it.

In its general working form the invention accordingly concerns an electrical pin-and-socket connector, particularly for use between a socket (primer capsule) and an electrical control device for a restraint system in motor vehicles with the properties of patent claim 1.

By blocking the secondary locking element, an unintentional depressing of that element is effectively prevented until the pin-and-socket connector is put together so that a secure connection of the electrical pin-and-socket connector can take place only through pressure applied on the secondary locking element, and assembly occurs easily, as a result of which additional errors can be avoided.

By inserting the spring stop device in a pocket-shaped recess of the socket an especially space-saving, safe, and effective design of the electrical pin-and-socket connector is possible. The small structural size mentioned makes possible exclusively small insertion paths, requiring optimal precision to attain optimal function and safety. Through the mentioned design the manufacturer of the pin-and-socket connector can exactly dimension the molding, which is placed in the socket of the electrical pin-and-socket connector. In doing that, the pocket-shaped recess can also be provided in the molding.

The required flat construction of the electrical pin-and-socket connector for air bag restraint systems of motor vehicles is favored by the present invention because the feeder leg or extension and the spring stop device, whose free ends run to each other and border on one another in the blocking position, can be put in place in a very space-saving manner. In the preferred embodiment of the invention the spring stop device is one of the stop lances integrated in the case of the connector, which protrudes from the case surface in its resting position. On the stop lance the frame of the secondary locking element can run so that no additional components must be provided on the secondary locking element. This element need not have any recesses or extensions because in each case only the free ends of the spring stop device (stop lance) and the feeder leg or extension (frame) of the secondary locking element lie on one another and the stop lance recedes into the surface of the case by inserting the connector into the socket against the spring resistance of the stop lance, whereby it is released in the final position of the secondary locking element.

The securing of the secondary locking element against a loosening out of the pre-assembled position takes place through at least one spring stop arm on the case. The spring stop arm has the further function of locking, in the completely inserted position, in a recess of the socket/gasket ring. Through the spring arms of the secondary locking element a loosening of the spring stop arm from the recess is prevented by the spring arms grasping behind the stop arms. A disconnection of the pin-and-socket connector is only possible after loosening the secondary locking element stop catches which prevent such a disconnect by locking into the recess of the spring stop arm.

Taking into consideration the previously mentioned properties, a working form can be constructed in which the secondary locking element has the form of a match box that is open downwards and whose narrow sides form bars with recesses and the feeder leg(s) or extension(s) (22) is positioned on their long sides, whereby in the inside of the secondary locking element a guiding leg protrudes, which the secondary locking element guides with respect to the case of the pin-and-socket connector. The secondary element is placed on the trunk-like part of the case, which in this area has a width corresponding to that of the secondary locking element. The feeder leg or extension 22 is inserted in a recess of the case and runs to the spring stop device (stop lance), positioned against the direction of insertion. The recesses of the side bars serve to lock in place the first stop catches of the spring stop arms of the trunk. In this pre-assembled position the secondary locking element is not able to be moved/engaged and disengaged with respect to the case either in the direction of insertion, which is prevented by the stop lance, or against the direction of insertion, which is prevented by the first stop catches.

When inserting in the corresponding counterpart of the socket, which comprises the insertion contact, the gasket ring, and the short-circuiting bridge, the stop lance is pressed against its spring resistance in the surface of the trunk so that by reaching the end position of the feeder leg or extension of the secondary locking element a release occurs in the insertion direction and a pushing of the secondary locking element into the final position is possible. In this unlocking position second stop catches of the spring stop arms lock in the recesses of the side bars of the secondary locking element, while spring arms of the secondary locking element grip behind the spring stop arms so that a loosening of the spring stop arm from the recesses of the socket/gasket ring is prevented.

Additional properties of the invention result from the properties of the subclaims as well as any other application documents.

The invention is more closely explained below by the use of working examples.

Figure 1B:
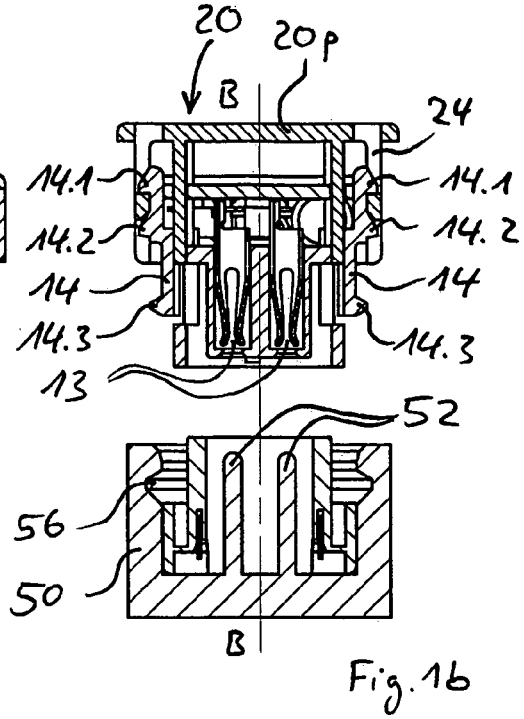
Figure 1C:
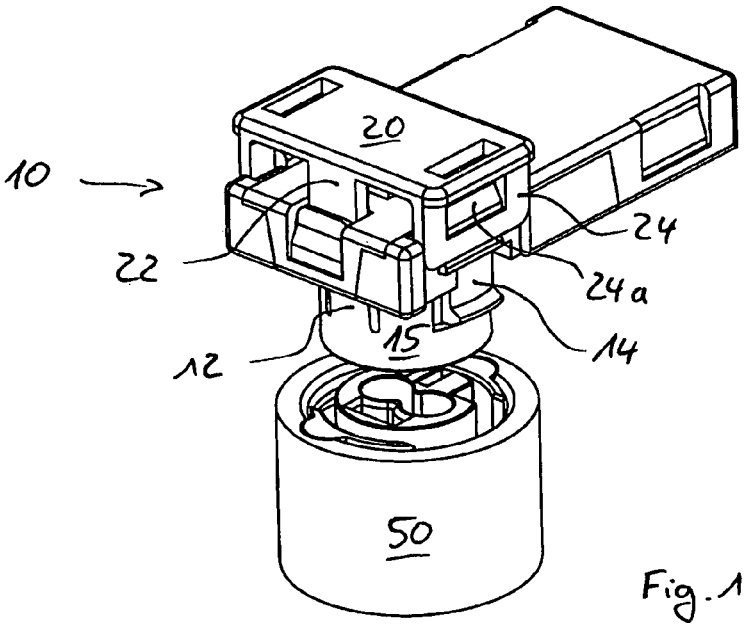
Figure 2A:
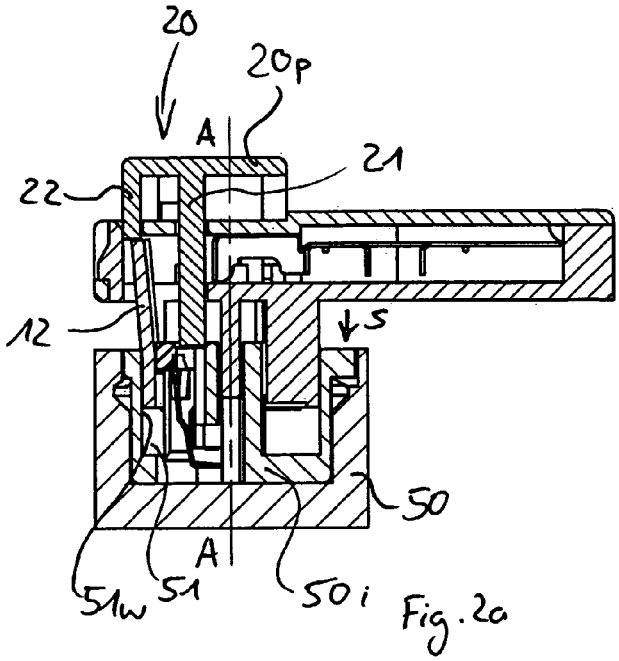
Figure 2B:
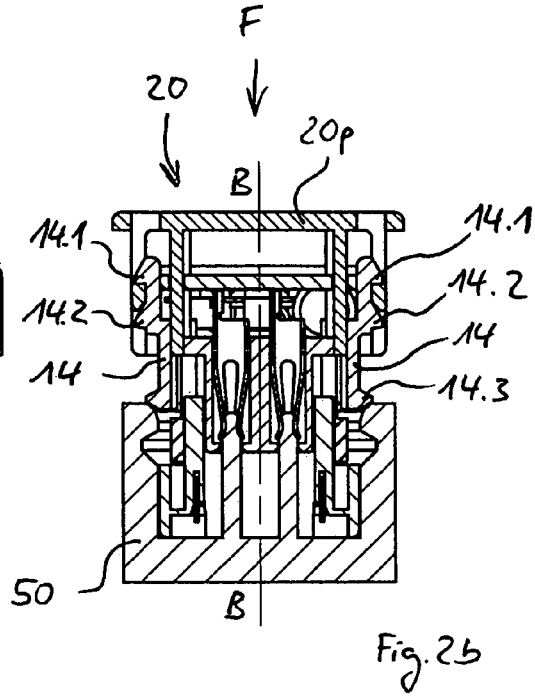
Figure 2C:
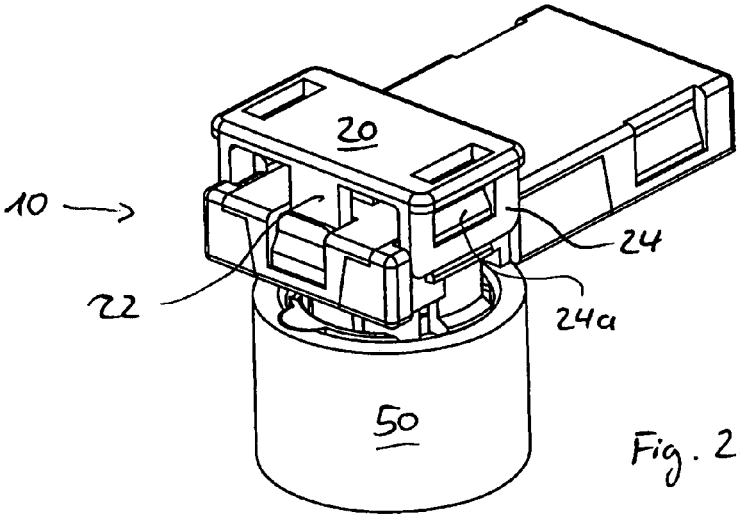
Figure 3A:
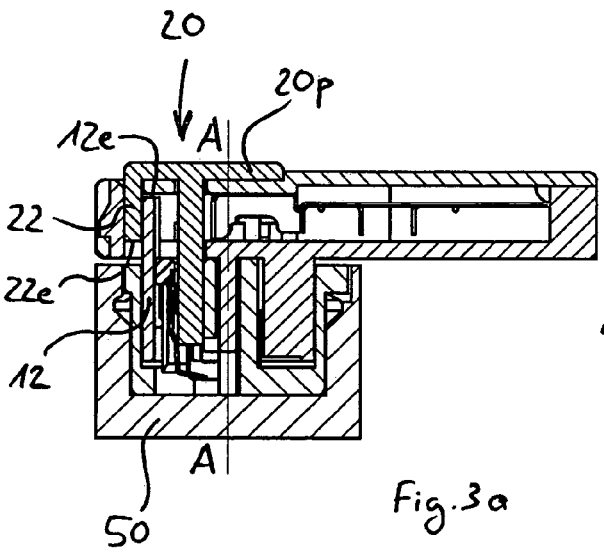
Figure 3B:
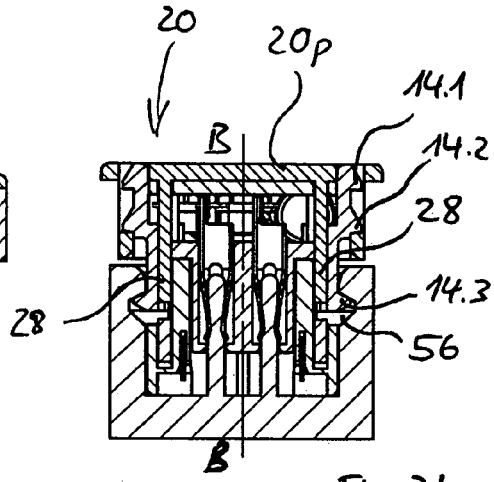
Figure 3C:
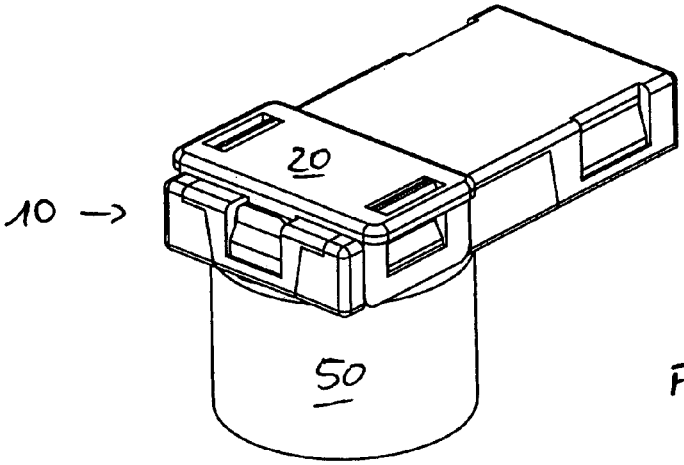

In that connection the following are shown, each in diagrammatic representation:

FIG. 1*a*: a cross-sectional side view of a pin-and-socket connector according to cut line B—B from FIG. 1*b* in a pre-assembled state, FIG. 1*b*: a crosss-sectional front view of the pin-and-socket connector according to cut line A—A in a pre-assembled state, FIG. 1*c*: a perspective view of the pin-and-socket connector in a pre-assembled state, FIG. 2*a*: a cross-sectional side view of a pin-and-socket connector according to cut line B—B in figure b in a half-used state, FIG. 2*b*: a cross-sectional front view of the pin-and-socket connector according to cut line A—A in FIG. 2*a* in a half-used condition, FIG. 2*c*: a perspective view of the pin-and-socket connector in a half-used state, FIG. 3*a*: a cross-sectional side view of a pin-and-socket connector according to cut line B—B from FIG. 3*b* in a used state, FIG. 3*b*: a cross-sectional front view of the pin-and-socket connector according to cut line A—A in FIG. 3*a* in a used state, FIG. 3*c*: a perspective view of the pin-and-socket connector in a used state.

The same or equally acting components are represented in the figures with the same reference numbers.

The pin-and-socket connector represented in the figures corresponds with respect to its fundamental construction to that of DE 102 27 016 B4. To this extent reference will be made on this document. The pin-and-socket connector accordingly has an L form in the side view, whereby the pin-and-socket connector in FIG. 1 is not put together. The upper part of the case 10 has essentially a rectangular basic form. Running in the insertion direction S are openings 13, in which contact springs are positioned, which with corresponding contact pins contact a corresponding socket 50 when the electrical pin-and-socket connector is in its locking state.

The essential components of the electrical pin-and-socket connector are the case 10 with the trunk 15, which are formed as one piece, the secondary locking element 20, and the socket 50.

The case 10 has a top 17 to enable access to the electrical contacts and connections, which are not described in greater detail. Furthermore, the case 10 has in its front section, positioned over the trunk 15, recesses and notches for the insertion, guiding, and securing of the secondary locking element 20. In the insertion direction S runs the trunk 15, which has a form matching the socket 50, in the present case a cylinder-shape.

One can see, formed in the trunk on the left side in FIG. 1*a*, a stop lance 12, which protrudes in a bar form from the cylinder lateral surface of the trunk 12 in a no-load state. The free end 12*e* of the stop lance 12 is pointed against the insertion direction S.

As one can see in FIGS. 1*b*, 1*c*, 2*b*, 2*c*, 3*b*, and 3*c*, the case 10 has, furthermore, spring stop arms 14, which fulfill several functions. The first stop catches 14.1, in each case positioned on opposite sides of the trunk (as the other stop catches are), secure the secondary locking element 20 by locking into recesses 24*a* of bars 24 and prevent a movement of the secondary locking element 20 against the insertion direction.

The second stop catches 14.2 serve to secure the secondary locking element 20 in the end position, as can be seen in FIGS. 3*b* and 3*c*.

The stop catches 14.3 fulfill the function of locking in recesses 56 of the socket 50 as soon as the case 10 is completely inserted into the socket 50. So that the stop catches 14.3 do not become inadvertently loosened from the recesses 56 of the socket 50, spring arms 28 of the secondary locking element 20 grasp behind the stop catches 14.3 of the spring stop arms 14 as soon as the secondary locking element is completely inserted.

The activation or the insertion of the pin-and-socket connector is brought about only through pressure on the basic or main part 20*p* of the secondary locking element 20. In the first two steps, which are represented in FIGS. 1 and 2, the feeder leg or extension 22 transfers on its free end 22*e* the pressure F on the free end 12*e* of the spring stop device 12 (stop lance) and thus on the case 10, which is pressed on the socket 50. The torque arising through the peripheral position of the feeder leg or extension 22 is taken up by the guiding leg 21 of the secondary locking element 20, whereby a jamming of the secondary locking element 20 with respect to the case 10 is prevented.

The guiding leg 21 serves, furthermore, in that with its free end 21*e* a locked/inserted position releases a short-circuiting bridge between the contact pins 52 of the socket 50.

The blocking position of the secondary locking element 20 represented in FIGS. 1 and 2, triggered by the support of the feeder leg or extension 22 on the spring stop device 12, is automatically released in such a way that the spring stop device 12, during insertion in a pocket-shaped recess 51 of an isolation ring 50*i*, pivots gliding in the direction of the socket interior 50 through the wall area 51*w* of the pocket-shaped recess 50, whereby the free end 12*e* of the spring stop device 12 is pushed relative to the free end 22*e* of the feeder leg or extension 22 and after the case 10 the spring stop device 12 is inserted to a certain depth, the secondary locking element 20 automatically releases. In so doing, the angle between the spring stop device 12 and the wall area 51*w* or the center axle of the cylinder-formed trunk lies between 1° and 10°.

The invention claimed is:

1. An electrical connector, for use between a socket and an electrical control device for a restraint system in motor vehicles, comprising:

a case having contact elements for electrical connection with contact elements of the socket; and a locking element with at least one extension protruding from a main part of the locking element that engages a spring stop device of the case when the locking element is inserted in the case, whereby the extension is designed in such a way that it props up against the case in the insertion direction in a pre-assembled initial position, and the case can be inserted in the socket through the pressure on the main part of the locking element, and the spring stop device being pivotable into a release position from a blocking position through a sliding guiding action on a wall area of the socket against the spring resistance of the spring stop device.

2. The connector of claim 1, in which the wall area is an inner wall area in a pocket-shaped recess of the socket.

3. The connector of claim 1, in which the spring stop device is designed as a stop lance.

4. The connector of claim 1, in which at least one spring stop arm is provided on the case to secure the case to the socket.

5. The connector of claim 1, in which the free ends of the spring stop device and the extension contact each other in the pre-assembled initial position.

6. The connector of claim 1, in which a guiding leg has such a length that it causes, in its completely inserted position in the socket, an effective short-circuiting bridge between the contact elements with its free ends.

7. The connector of claim 4, in which the spring stop arms are grasped from behind by spring arms when the case is in a completely inserted position in the socket so that a release of the spring arms from a recess is prevented.

8. The connector of claim 1, in which the case has a trunk and the spring stop device is integrated with the trunk.

9. The connector of claim 1, in which the resting position of the spring stop device is in the blocking position and protrudes from the surface of the case, especially at an angle of between 1° and 10° against the case surface.

10. The connector of claim 1, in which the secondary locking element has bars with recesses on the side, in which first stop catches of the spring stop arms lock in to secure the secondary locking element from loosening out of the pre-assembled initial position.

11. The pin-and-socket connector of claim 2, in which a gasket ring is inserted in the socket in which the pocket-shaped recess of the socket is formed.

* * * * *

UNITED STATES PATENT AND TRADEMARK OFFICE

CERTIFICATE OF CORRECTION

PATENT NO. : 7,108,540 B2
APPLICATION NO. : 11/181945
DATED : September 19, 2006
INVENTOR(S) : Alfred Annecke It is certified that error appears in the above-identified patent and that said Letters Patent is hereby corrected as shown below:

On the Title Page, Item "(57) ABSTRACT", delete Abstract, and replace it with the following Abstract:

The invention concerns an electrical connector for use between a socket and an electrical control device for a restraint system in motor vehicles. The connector includes a case having contact elements for electrical connection with contact elements of the socket. The case also includes a locking element with at least one extension that engages a spring stop device on the case when the locking element is inserted in the case. The spring stop device is pivotable into a release position through a sliding action.

Signed and Sealed this

Twenty-sixth Day of June, 2007

JON W. DUDAS
*Director of the United States Patent and Trademark Office*